US007374472B2

(12) United States Patent
Zheng

(10) Patent No.: US 7,374,472 B2
(45) Date of Patent: May 20, 2008

(54) METHOD FOR MANUFACTURING DECORATIVE STONE

(75) Inventor: Yu Zheng, Shenzhen (CN)

(73) Assignee: Cardiny Stone (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 11/484,140

(22) Filed: Jul. 11, 2006

(65) Prior Publication Data

US 2007/0232198 A1 Oct. 4, 2007

(30) Foreign Application Priority Data

Mar. 29, 2006 (CN) ..... 2001 1 0060113

(51) Int. Cl.
*B24B 1/00* (2006.01)

(52) U.S. Cl. ..... 451/28; 451/57; 451/910

(58) Field of Classification Search ..... 451/11, 451/28–31, 41, 57, 910; 125/1, 30.01
See application file for complete search history.

(56) References Cited

U.S. PATENT DOCUMENTS 3,842,488 A * 10/1974 Mitchell ..... 29/527.6
5,185,192 A 2/1993 Banus
5,273,620 A * 12/1993 Lamberti ..... 216/30
5,656,109 A * 8/1997 Schilling et al. ..... 156/63
6,155,245 A 12/2000 Zanzuri
6,616,372 B2 9/2003 Seroka et al.
6,772,748 B2 * 8/2004 Cleary ..... 125/1
2005/0238856 A1 10/2005 Zanzuri
2006/0127611 A1 6/2006 Hunter

OTHER PUBLICATIONS

Co-pending U.S. Appl. No 11/484,478, filed on Jul. 11, 2006.
Co-pending U.S. Appl. No 11/484,127, filed on Jul. 11, 2006.
Co-pending U.S. Appl. No 11/484,138, filed on Jul. 11, 2006.
Co-pending U.S. Appl. No 11/484,479, filed on Jul. 11, 2006.
Office Action Issued in co-pending U.S. Appl. No. 11/484,478 mailed Sep. 8, 2006.
Office Action Issued in co-pending U.S. Appl. No. 11/484,478 mailed Mar. 9, 2007.

* cited by examiner

*Primary Examiner*—Dung Van Nguyen
(74) *Attorney, Agent, or Firm*—Hamre, Schumann, Mueller & Larson, P.C.

(57) ABSTRACT

A method of using ultrasonic cutting technology to make a decorative stone includes cutting a stone or other decorative materials into certain positive pieces having various shape by the ultrasonic cutting technology; cutting another stone to certain depth but not through according to the shape of the positive piece to make a negative piece by the ultrasonic cutting technology; taking out cut-off pieces from the stone; inlaying the positive pieces into the negative piece to form an integrated piece; and polishing a surface of the positive pieces and the negative piece. This ultrasonic technology can bring high manufacture efficiency and the inlay can be industrialized easily. It also increases the decorative effect due to having different pattern and specificity of stones.

5 Claims, 2 Drawing Sheets

METHOD FOR MANUFACTURING DECORATIVE STONE

BACKGROUND OF THE INVENTION

1. Field of the Invention

The present invention relates to a field of decorative stones, and more especially to a method for manufacturing a decorative stone.

2. Description of the Prior Art

A decorative stone is one type of building stones which has function of decoration and can be used for architectural decoration or furniture tops. The pattern of cutting a decorative stone to form certain shape is normally by a diamond disk saw or a diamond wire saw. Unfortunately, subjected to the restriction of the specificity of the cutting tool and the work piece, the work piece could not be machined accurately during manufacturing. The known machine pattern also fails to machine the work piece as various predetermined shapes without penetrating the work piece.

Ultrasonic cutting technologies are increasingly used for cutting stones. One of them is an ultrasonic cutting tool which creates ultrasonic vibration by putting voltage on a ceramic vibrator. After that, the ultrasonic vibration is amplified to generate forty thousand vibrations pre second on the tool head and then add abrasive between the cutting tool and the work piece, which can cut materials easily.

The art of the stone inlay was used even in the ancient India, but by far this art is embodied by manual work none the less. However, it is of course not ensured that each product of each-time production is identical to another, so this art is unable to be industrialized and the manufacturer using this way can not have mass production based on the identical design of the order form in modern commercial distribution field.

BRIEF SUMMARY OF THE INVENTION

A primary object of the present invention is to provide a method for manufacturing a decorative stone which utilizes ultrasonic cutting technology to cut stones and inlays different pattern and specificity stones to increase decorative effect.

To achieve the above-mentioned object, a method for manufacturing a decorative stone comprises steps of: cutting a stone or other decorative materials into certain positive pieces having various shape by the ultrasonic cutting technology; cutting another stone to certain depth but not through according to the shape of said positive piece to make a negative piece by the ultrasonic cutting technology; taking out cut-off pieces from said stone; inlaying said positive pieces into said negative piece to form as an integrated piece; and polishing the surface of said positive pieces and said negative piece.

Advantageously, first metal molds are used for cutting a stone into certain positive pieces having various shape by the ultrasonic.

Advantageously, second metal molds which have the same shape as said first metal molds but a bit smaller size are used for cutting another stone to form said negative piece.

Advantageously, the method further comprises: utilizing adhesives between said positive pieces and said negative piece.

Advantageously, said negative piece is a common stone tile or a sandwich stone tile.

Advantageously, said inlaid sandwich stone tile is a stone-stone, or a stone-ceramic tile, or a stone-fiberglass, or a stone-aluminum plastic, or a stone-metal, or a stone-aluminum honeycomb, or a stone-composite material.

In accordance with the present invention, the ultrasonic cutting technology can bring high manufacture efficiency and the inlay can be industrialized easily. It also increases more decorative effects through inlaying different pattern and specificity stones.

Other objects, advantages and novel features of the present invention will become more apparent from the following detailed description when taken in conjunction with the accompanying drawings, in which:

DETAILED DESCRIPTION OF THE INVENTION

Figure 1:
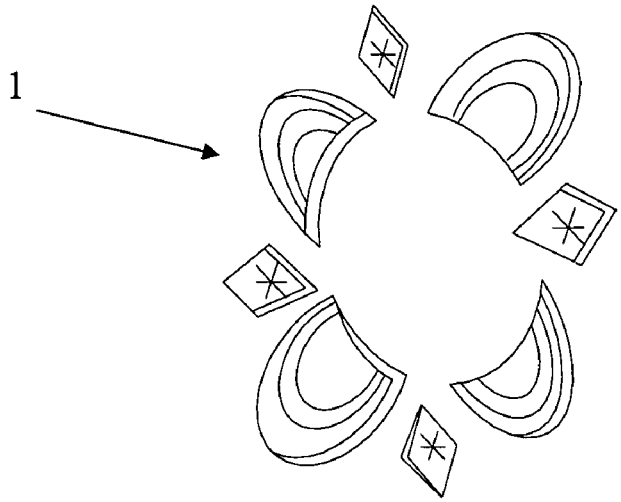
FIG. 1 is a schematic view showing a positive piece in accordance with the present invention.

A method for manufacturing a decorative stone in accordance with a preferred embodiment of the present invention includes steps as follows:

At the step 1, referring to FIG. 1, on the basis of requirements of different designs, various metal molds (namely the first metal molds) are used for cutting stone (or other decorative materials) into certain positive pieces 1 having various shape by the ultrasonic cutting technology.

Then turn to the step 2, making another set of metal molds (namely the second metal molds) which have the same shape as the first metal molds but a bit smaller size. Using the second metal molds to cut another stone to certain depth. It should be note that here the cut is not through, only to certain depth. The actual depth depends on the shape and the design. Since the second metal molds have a thickness themselves, the cut-off pieces are a little larger than the positive pieces 1.

Figure 2:
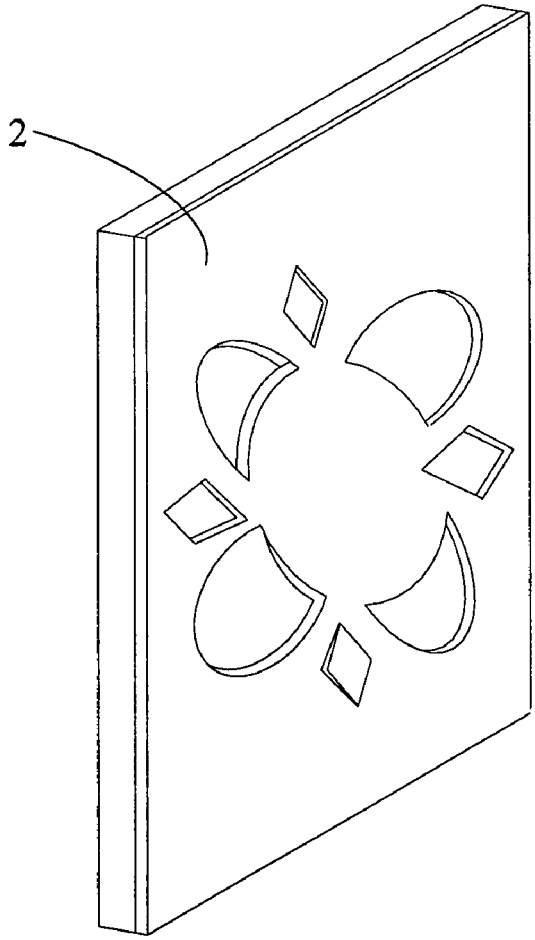
FIG. 2 is a schematic view showing a negative piece in accordance with the present invention.

At the step 3, referring to FIG. 2, taking out the cut-off pieces which have designated shapes by a tool. The remaining one is called negative piece 2.

Figure 3:
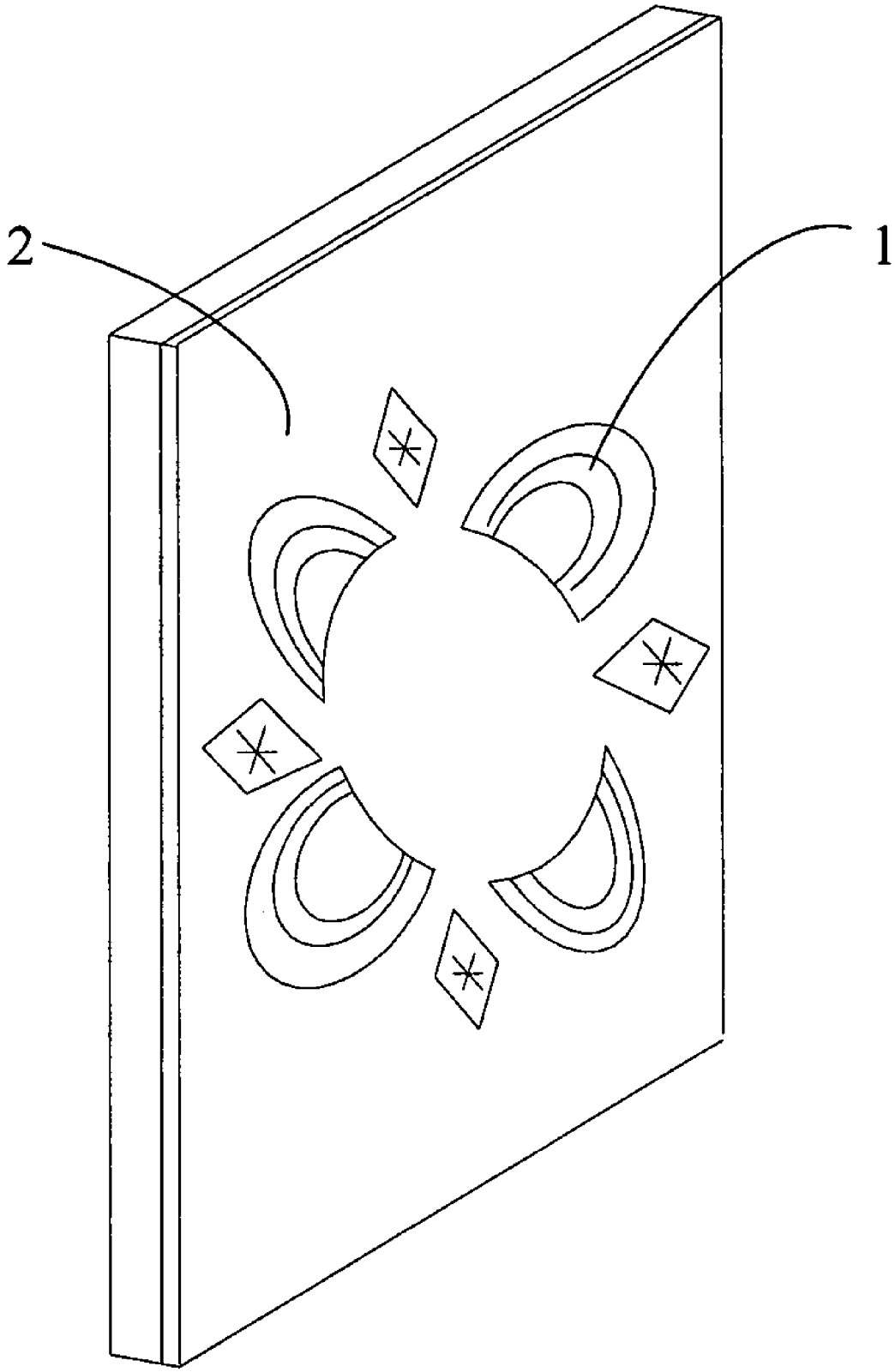
FIG. 3 is a schematic view showing the inlay of the positive and negative pieces in accordance with the present invention.

At the step 4, referring to FIG. 3, inlaying the positive pieces 1 into the negative piece 2 with adhesives to form as an integrated piece.

Finally, at the step 5, polishing a surface of the positive pieces 1 and the negative piece 2.

Advantageously, it is preferred to choose a sandwich stone tile such as stone-stone, stone-ceramic tile, stone-fiberglass, stone-aluminum plastic, stone-metal, stone-aluminum honeycomb, stone-composite material or the like to manufacture the negative piece 2. The inlaid sandwich stone tile is made by a combination of a thin layer of stone (2–8 mm) and another layer of other materials. The benefit of choosing the sandwich stone tile lies in that the cutting becomes easier and it is more conventionally to take out the cut-off pieces for the reason of structural specificity of inlaid sandwich stone tile.

In accordance with the present invention, it could adopt stones having different pattern and specificity respectively as the positive pieces 1 and the negative piece 2 so as to increasing more decorative effects of the inlaid piece.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A method for manufacturing a decorative stone comprising steps of:

cutting a stone or other decorative materials into certain positive pieces having various shapes by using an ultrasonic cutting technology;

cutting another stone without passing through by using the ultrasonic cutting technology according to the shape of said positive pieces to make a negative piece;

taking out cut-off pieces from said negative piece;

inlaying said positive pieces into said negative piece to form an integrated piece; and polishing a surface of said integrated piece, wherein first metal molds are used for cutting the stone or the other decorative materials into the positive pieces having the various shapes by using the ultrasonic cutting technology.

2. The method as claimed in claim 1, wherein, during inlaying, utilizing adhesives to engage said positive pieces and said negative piece.

3. The method as claimed in claim 1, wherein said negative piece is a common stone tile or a sandwich stone tile.

4. The method as claimed in claim 3, wherein said sandwich stone tile is selected from the group consisting of stone-stone, stone-ceramic tile, stone-fiberglass, stone-aluminum plastic, stone-metal, stone-aluminum honeycomb, and stone-composite materials.

5. A method for manufacturing a decorative stone comprising steps of:

cutting a stone or other decorative materials into certain positive pieces having various shapes by using an ultrasonic cutting technology;

cutting another stone without passing through by using the ultrasonic cutting technology according to the shape of said positive pieces to make a negative piece;

taking out cutt-off pieces from said negative piece;

inlaying said positive pieces into said negative piece to form an integrated piece; and polishing a surface of said integrated piece, wherein second metal molds having the same shapes as but a smaller size than said first metal molds are used for cutting the another stone to form said negative piece.

* * * * *